US008950692B2

(12) United States Patent
Liu

(10) Patent No.: US 8,950,692 B2
(45) Date of Patent: Feb. 10, 2015

(54) WATER FAUCET

(76) Inventor: Xionghui Liu, Guangdong (CN)

( * ) Notice: Subject to any disclaimer, the term of this patent is extended or adjusted under 35 U.S.C. 154(b) by 138 days.

(21) Appl. No.: 13/807,711

(22) PCT Filed: Dec. 15, 2011

(86) PCT No.: PCT/CN2011/084044

§ 371 (c)(1),
(2), (4) Date: Dec. 28, 2012

(87) PCT Pub. No.: WO2012/083812

PCT Pub. Date: Jun. 28, 2012

(65) Prior Publication Data

US 2013/0105016 A1 May 2, 2013

(30) Foreign Application Priority Data

Dec. 24, 2010 (CN) ..... 2010 1 0605587

(51) Int. Cl.

| | |
|---|---|
| ***E03C 1/08*** | (2006.01) |
| ***E03C 1/084*** | (2006.01) |
| *B05B 1/30* | (2006.01) |
| *B05B 7/04* | (2006.01) |
| *E03C 1/02* | (2006.01) |

(52) U.S. Cl.

CPC ..... *E03C 1/084* (2013.01); *B05B 1/3013* (2013.01); *B05B 7/0425* (2013.01); *B05B 7/0483* (2013.01); *E03C 2001/026* (2013.01)

USPC ..... 239/428.5; 239/434; 239/581.2; 239/583

(58) Field of Classification Search

CPC ..... B05B 7/0425; E03C 1/084

USPC ..... 239/428.5, 434, 583, 581.1–582.1

See application file for complete search history.

(56) References Cited

U.S. PATENT DOCUMENTS 5,964,410 A 10/1999 Brown et al.

FOREIGN PATENT DOCUMENTS

| | | | |
|---|---|---|---|
| CN | 2279960 | Y | 4/1998 |
| CN | 2866992 | Y | 2/2007 |
| CN | 101204684 | A | 6/2008 |
| CN | 201554939 | U | 8/2010 |
| CN | 101905201 | A | 12/2010 |
| CN | 102072327 | A | 5/2011 |
| DE | 4140714 | C1 | 6/1993 |

OTHER PUBLICATIONS

International Search Report, mailing date Feb. 9, 2012, for corresponding International Application No. PCT/CN2011/084044.

*Primary Examiner* — Christopher Kim

(74) *Attorney, Agent, or Firm* — Intellectual Property Law Group LLP

(57) ABSTRACT

Disclosed is a water faucet, in which a main body (1) is composed of a water outlet channel (2) and a water inlet channel (3), with a micro flow ejector (5) having a vent hole (4) fitted between the water outlet channel (2) and the water inlet channel (3), a flow-adjusting positioning screw (6) fitted on a hollow inner circular tube wall (14) behind the micro flow ejector (5), between the micro flow ejector (5) and the flow-adjusting positioning screw (6) there being fitted a hollow flow regulating valve (8) which is T shaped at the rear portion and cone shaped at the head portion; wherein the cone-shaped head portion of the hollow flow regulating valve (8) is provided with an ejecting orifice (9), the small cylindrical tube wall of the hollow flow regulating valve (8) is provided with more than one water inlet/outlet hole (10), and an air inlet check valve (13) is placed in the vent hole (4) of the micro flow ejector (5). By using the water faucet with the above-mentioned structure of the present application, users are able to conveniently control and regulate the flow rate of water consumption at will, to obtain a water quality activated by highly effective oxygenation during water utilization, with a water supply amount between 1.5 liters and 9 liters per minute under a water supply pressure range of 0.1 MPa to 0.35 MPa.

6 Claims, 2 Drawing Sheets

WATER FAUCET

CROSS-REFERENCE TO RELATED APPLICATIONS

This application is a U.S. National Phase application, under 35 U.S.C. §371, of International Application no. PCT/CN2011/084044, with an international filing date of Dec. 15, 2011, and claims benefit of China Application no. 201010605587.0 filed on Dec. 24, 2010, and which are hereby incorporated by reference for all purposes.

FIELD OF INVENTION

The present invention relates to a water faucet, and in particular, to a water faucet with an improved water device structure to a tap water supply.

BACKGROUND

The vast majority of water wasting is closely related to the improper use of water faucets in the reality of production and living, and such improper use is caused by the unreasonable structure of the faucet. In order to fundamentally realize scientific water conservation, it is necessary to thoroughly improve the structure of existing faucets. At present, there are two types of water-saving faucets/taps: one is a flow-limiting and pressure-regulating spraying water nozzle. It uses the fluid continuity principle and conservation of energy principle. In the water exit of the faucet, there is a fixed hole choke device to cause the small water flow to realize a high-speed jet flow and spray the atomized water, and due to the high flow impact of the water there is an increase in the efficiency of decontamination and thus a realization of water-saving. However, such small flow high-speed spraying cannot solve the problem of large flow faucets which causes water sputtering.

The other type of water-saving faucets includes fixed resistance and flow-limiting bubbler faucets. Its working principle is to use the divergence holes on the blistering core to accelerate the water flow and form multi-strand linear water and inhaled air inside the bubbler, mixing the outflow of the multi-layer mesh containing bubbles of water effluent to slow down the speed of water flow and reduce the actual water flow, so as to achieve the purpose of water-saving and anti-sputtering. However, the main defect is that this kind of faucet cannot dynamically handle changes which affect the flow resistance associated with good water pressure and effluent, flow rate, water conflicts and water foaming.

The higher the water pressure is, the better the foaming effect will be. When the water pressure is low, the water flow is often as thin as chopsticks.

SUMMARY OF INVENTION

An object of this invention is to provide a kind of faucet to users who can control the adjustment of the water flow. With this mode of operation, water flow can be synchronized to convert its water resistance, adjust the velocity of flow, and regulate the applicable water shape. Within the water supply pressure for the range of 0.1~0.35 MPa, users can freely adjust and compensate for changes of the water pressure. When using stepless adjustment, users can get 1.5 to 9 liters of water consumption per minute.

According to an embodiment of the present invention, the main body of the water faucet is composed of a water outlet channel 2 and a water inlet channel 3, a micro flow ejector 5 with a vent hole 4 positioned between the water outlet channel

2 and water inlet channel 3. In the back end of the micro flow ejector 5, there is a hollow inner circular tube wall 14 that is equipped with a flow-adjusting positioning screw 6. An adjustable shroud 7 is equipped in the front end of the micro flow ejector 5 and at the exit end of the external tube wall of the water outlet channel 2. Between the micro flow ejector 5 and the flow-adjusting positioning screw 6, there is a hollow flow regulating valve 8 with a T-shaped rear part and a cone-shaped head part. In the cone-shaped head part of the hollow flow regulating valve 8, there is provided a spray/ejecting orifice 9. In a small cylindrical wall of the hollow flow regulating valve 8 there is provided more than one water inlet/outlet hole 10. In the back-end tube wall of the hollow flow regulating valve 8, there is provided more than one seal groove 11 with an opened seal ring 12. The back-end of the hollow flow regulating valve 8 is equipped with a seal fixed block 16 having a back-end center that is open with the process control screw hole 17. The front conical head angle of the hollow flow regulating valve 8 is identical with the angle of the flaring part of the inflow end the of micro flow ejector 5. There is an air inlet check valve 13 installed in the vent hole 4 of the micro flow ejector 5.

In order to allow users to easily and conveniently rotate and adjust the flow-adjusting positioning screw 6, a internal screw nut 15 is firmly implanted in the hollow inner circular tube wall 14 at the back-end of the main body of the water faucet 1. The bore diameter of the screw is smaller than the bore diameter of the hollow inner circular tube wall 14 at the back-end of the main body of the water faucet 1, from which a screw thread lock axis can be screwed in and its backward and forward moving distance is stopped at the back-end of the hollow flow regulating valve 8. The back-end of the flow-adjusting positioning screw 6 can serve as the turning handle.

DETAILED DESCRIPTION OF SPECIFIC EMBODIMENTS

The following description, combined with the drawings, provide details of the structure and mode of use of the water faucet according to embodiments of the present invention.

Elements of the Figures:

| | | | |
|---|---|---|---|
| 1 | main body of the water faucet | 2 | water outlet channel |
| L | water outlet channel wall length | rl | water outlet channel bore diameter |
| r2 | water outlet channel end bore diameter | 3 | water inlet channel |
| 4 | vent hole | 5 | micro flow ejector |
| 6 | flow-adjusting positioning screw | 7 | adjustable shroud |

-continued

| Elements of the Figures: | | | |
|---|---|---|---|
| 8 | hollow flow regulating valve | 9 | spray/ejecting orifice |
| 10 | water inlet/outlet hole | 11 | seal groove |
| 12 | seal ring | 13 | air inlet check valve |
| 14 | hollow inner circular tube wall | 15 | internal screw nut |
| 16 | seal fixed block | 17 | process control screw hole |
| 18 | minor diameter | 19 | pitch diameter |
| 20 | major diameter | 21 | ring gasket |
| 22 | inner ring surface | 23 | external ring surface |
| 24 | groove | 25 | seal ring |
| 26 | plughole | 27 | shroud surface |
| 28 | plughole angle | 29 | jet hole |
| 30 | external threaded coupling | 31 | inflow switch tube socket |
| 32 | water pipe | | |

Figure 1:
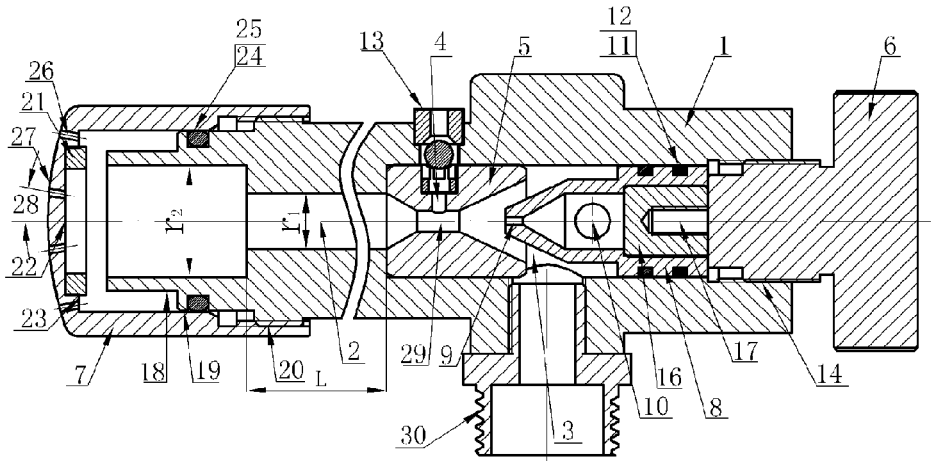
FIG. 1 is a cross-sectional structural diagram of the water faucet, according to an embodiment of the present invention.

As it is shown in FIG. 1, the main body of the water faucet according to an embodiment of the invention, is composed of a water outlet channel 2 and water inlet channel 3, and there is a micro flow ejector 5 with a vent hole 4 between the water outlet channel 2 and water inlet channel 3. In the back end of the micro flow ejector 5, the hollow inner circular tube wall 14 is equipped with a flow-adjusting positioning screw 6. The adjustable shroud 7 is provided in the front end of the micro flow ejector 5 and at the exit end of the external tube wall of the water outlet channel 2. Between the micro flow ejector 5 and the flow-adjusting positioning screw 6, there is a hollow flow regulating valve 8 with a T-shaped rear part and a conical-shaped head part. In the conical-shaped head part of the hollow flow regulating valve 8, there is a spray/ejecting orifice 9. In the small cylindrical wall of the hollow flow regulating valve 8 there is more than one water inlet/outlet hole 10. In the back-end of the tube wall of the hollow flow regulating valve 8, there are a plurality of seal grooves 11 with seal ring 12 opened. The back-end of the hollow flow regulating valve 8 is equipped with a seal fixed block 16 whose center at the back-end is open to the process control screw hole 17. The front conical head angle of the hollow flow regulating valve 8 is identical with the angle of the flaring part of the inflow end of the micro flow ejector 5. There is an air inlet check valve 13 installed in the vent hole 4 of the micro flow ejector 5.

In order to ensure that in the course of using the faucet, the main body of the water faucet 1 receives a dynamic seal, regulation is provided with an adjustable shroud 7. The exit end of the tube wall of the water outlet channel 2 in the main body of water faucet 1, changes in diameter in a ladder-extension-like manner from the outside to the inside through a minor diameter 18, to a pitch diameter 19, to a major diameter 20. In the tube wall of the pitch diameter 19, a circular groove/external ring surface 23 is set up and uses a seal ring 25 and the adjustable shroud 7 to form the dynamic seal. The diameter difference between the tube wall of the minor diameter 18 and the pitch diameter 19 is associated with the corresponding area of the water outlet channel 23 of the external ring surface on the ring gasket 21 of the shroud surface 27. With the requirements of the water exit holes to scale up the tube wall diameter of the pitch diameter 19 and the major diameter 20, such will correspondingly increase the area of the water exit channel 23 of the external ring surface on the ring gasket 21 of the shroud surface 27. With the axial connection of the screw thread and the adjustable shroud 7 in the tube wall of the major diameter 20, it can be screwed tight or loose. The connection part of the screw thread can change in diameter synchronously with the tube wall of the major diameter 20 which can be greater than the tube wall of the water outlet channel 2.

The water outlet channel 2 of the water faucet according to an embodiment of the invention, serves to accept and restrict high-speed spraying of air water flow from the conical flaring and to cluster the air water flow to one direction so as to accelerate and increase the aeration effects in the water. In order to coordinate with the connection screen of the adjustable shroud 7, the water outlet channel 2 forms a controlled aeration increased oxygen water curtain wall to buffer, and the buffer area is proportional to the water flow of jet hole 29 in the micro flow ejector 5. The water outlet channel 2 exit end expands several times and expands and increases the volume of the water outlet channel end bore diameter r2. In actual use, the water outlet channel bore diameter r1 is within the range of 5 to 8 mm and dock joints with the conical flaring of the micro flow ejector 5. The water outlet channel wall length L is within the range of 10 to 400 mm, and users can meet fission production with their specific requirements such as making a gooseneck-shape and then a docking joint. Rotating radially the outflow angle and upwards spraying can meet the needs of aesthetic design.

The adjustable shroud 7 of the water faucet according to an embodiment of the invention, is similar to the shape of a barrel, and the shroud surface 27 is arranged with many evenly distributed water plugholes 26, and the bore diameter is within the range of 0.8 to 2 mm, which is divided by a ring gasket 21 into inner ring surface 22 and external ring surface 23. Different rings arranged in different water holes form different water resistance. Ring gasket 21 of the shroud surface 27 corresponds with the main body of the faucet exit end minor diameter 18 of circular tube wall, and through the adjustable shroud 7, it can be tightened to a compression fitting seal. The shroud surface 27 forms a relatively high water resistance and water can only flow through the water hole of the inner ring surface 22 which realizes the flow acceleration and concentration. When screwed loose, the inner ring surface 22 of shroud surface 27 intercommunicates with the exit hole of the external ring surface 23 and meanwhile diverts water to form a relatively low water resistance flow to decelerate the velocity. The outside shape of the shroud surface 27 is curved and its plughole angle 28 of the water plughole 26 is within 10 to 28 degrees which can achieve more spray area with a smaller shroud surface 27.

Through the stepless adjustment of the flow-adjusting positioning screw 6, increase or decrease the flow to reach the plughole 26 of the shroud surface 27 in order to change the velocity and water form. It can dynamically handle the contradiction of water pressure. Water flow associated with water resistance changes or affects velocity, water shape, and resolves the problem that the dynamical match cannot have a direct impact on the water shape.

Figure 2:
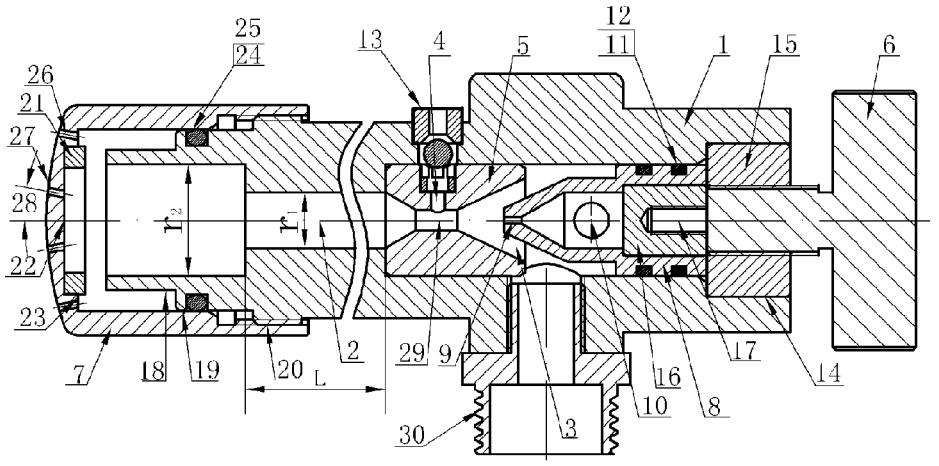
FIG. 2 is a cross-sectional structural diagram of the water faucet showing the internal screw nut 15 firmly implanted in the back-end of the main body of the water faucet, according to an embodiment of the present invention.

As it is shown in FIG. 2, in order to solve the problem that users must overcome the operational difficulties of screwing the flow-adjusting positioning screw 6 which provides the water pressure, in the hollow inner circular tube wall 14 of the back-end of the main body of the water faucet 1, internal screw nut 15 is firmly implanted. By reducing the diameter of the flow-adjusting positioning screw 6 and increasing the moment of the couple, users can reduce the abrasion of the radial rotation operation and rotating force required of users accordingly. It improves operational flexibility and comfort. The setting of the process control screw hole 17 is convenient provided for assembly and maintenance.

Figure 3:
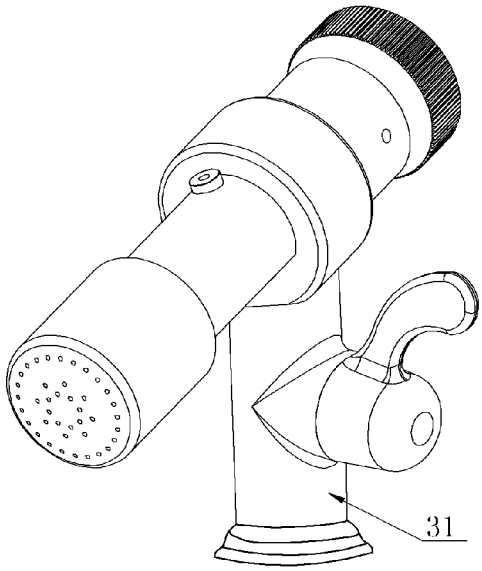
FIG. 3 illustrates a horizontal installation of the main body of the water faucet directly through the external screwed joint 30, water pipe 32 and inflow switch tube socket 31, according to an embodiment of the present invention.

As shown in FIG. 3, the structure of the water faucet according to an embodiment of the invention, can realize a horizontal connection to accommodate a basin and a rain shower in the bathroom.

The water inlet channel 3 of the water faucet according to an embodiment of the invention, is connected to the source of the water by an external screwed joint 30 and inflow switch tube socket 31. Water flow enters the main body of the water faucet 1 through water inlet channel 3. The back-end of the hollow flow regulating valve 8 is locked by the axial direction of the flow-adjusting positioning screw 6 to move backward of the stoke position. It is sealed and separated by a seal ring 12 radially formed in the hollow flow regulating valve 8 having a large and small cylindrical diameter of difference space. The angle of the front end of the conical head of the hollow flow regulating valve 8 is identical with the inflow end conical flaring part of the micro flow ejector 5 which constitutes a fitting removable conical ring gap of a dynamic seal space with water inlet channel 3, and the other side of the seal ring 12 is separated by the formation of water pressure in the process of water use. In water pressure under the action of natural force, the hollow flow regulating valve 8 along the axial rear-position separation increases a tapering ring gap space of the water inlet channel 3, making the water flow by the tapering ring gap and the hollow flow regulating valve 8, the inlet/outlet water hole 10, ejecting orifice 9, and import into the jet hole 29 of the micro flow ejector 5. The water flow changes with the size of the conical ring gap and automatically balance water interchangeably to enter the micro flow ejector 5 jet hole 29. By regulating the size of the conical ring gap to spray a variety of water types such as a cluster spray, a divergent spray, and a mist spray. The ejecting orifice 9 of the hollow flow regulating valve 8 can be used as water-gun nozzle to directly open adjustable shroud 7. When the flow-adjusting positioning screw 6 is moved to a maximum stroke, and the opening of the conical ring gap is to the maximum, the water inlet channel 3 flow pressure balance makes two flow channels of the hollow flow regulating valve 8 and the water inlet/outlet hole 10 and the conical head center ejecting orifice 9 naturally stops. When the flow-adjusting positioning screw 6 is moved to a minimum stroke, the opening of the conical ring gap is sealed by the front end of the conical head of the hollow flow regulating valve 8 completely, so that water can go through the water inlet/outlet hole 10 with the ejecting orifice 9, the ejecting orifice 9 becomes a micro flow ejector 5 composite little jet hole and gets tap water to provide the maximum static water pressure. When the conical ring gap is not completely closed, the high-speed cluster jet kinetic energy provided by the ejecting orifice 9 also has a conical ring gap inflow ejector pumping fluid to help raise the micro flow ejector 5 jet water intensity of low resistance and the adjustable shroud 7 out of water to match the nozzle flow effect can increase water use by about 30 percent. The jet hole 29 bore diameter of this water faucet is 4.2 mm, the standard water pressure is 0.11 MPa, and technically it is possible to achieve water supply for more than 9 liters per minute. Depending on different use standards, users can down regulate the bore diameter of jet hole 29 to regulate and control the upper limit of the water supply so as to limit it under 9 liters per minute, and the bore diameter can be selected within the range between 2.5 to 4.5 mm. When the bore diameter of the ejecting orifice 9 is 1.3 mm, the fixing hole lower limit of water flow can be controlled to get 1.5 to 1.8 liters per minute, and the bore diameter is selected between 0.8 mm to 1.8 mm.

The main body of the water faucet according to an embodiment of the invention, can realize a water flow regulation through the flow combination of the air inlet check valve 13 and the adjustable shroud 7 in the process of using water. It can convert water resistance to change the flow pressure in the shroud, except by getting the high grade using function of the unique effects of low water resistance to flow, it can also get resistance from low water flow conversion to high water resistance to a full pipe outflow stream of entirely different functional effect and at the same time it is with the characteristic of the flow regulating valve transporting a larger water supply pressure kinetic energy. Technically, a match guarantee in the process of high and low water pressure, and large or small flow of water can make the micro flow ejector 5 obtain the necessary high-speed cluster jet kinetic energy, provide the jet hole 29 to speed up and step down to generate negative pressure; in the vent hole 4 air is pumped in through air inlet check valve 13, and goes through water outlet channel 2 to form the directional high-speed air-water mixture flow which will directly aim at the adjustable shroud 7. It makes air and water strongly impact and obtains sputtering rapid expansion of the aeration so as to rapidly increase the volume of the air-water pressure, and form the buffer gas water curtain to realize the purpose of deceleration by using water to block the water itself. Under the impetus of the potential impact of high-speed air-water mixture flow and aeration pressure consolidating formation greater than the flow resistance, the adjustable shroud 7 and use of relative low water resistance, water flows fast through the shroud surface 27 to divert water, and forms a gas folder of water spewing like waterfall of raindrops falling out of the flow, which effectively solves the technical problems of high-speed flow to be controlled by low-speed outflow. Through the water aeration impact of a high-speed flow sputtering process to generate the activation effect and release negative ions, and promoting the ability of the liquid oxygenated capacity, promotes the exchange of material between the gas and liquid discharge aeration of volatile substances such as chlorine. When the adjustable shroud 7 converts relatively high outflow water resistance and a large flow of water leads to the water resistance pressure jets out by the micro flow ejector 5 higher than atmospheric pressure, the inlet check valve 13 will automatically close to prevent the water from reversing out from the air intake channel 4 which realizes the random match automatically converted to open and close, with the characteristics of the flow regulating valve to transport the kinetic energy of the larger water supply pressure and the flushing intensity of water-gun sputter pressure. It gives full play to the overall function of water supply, water technology matching and sets faucets, shower water gun use function all in one and realizes the effect of complementary advantages of the strengths.

Figure 4:
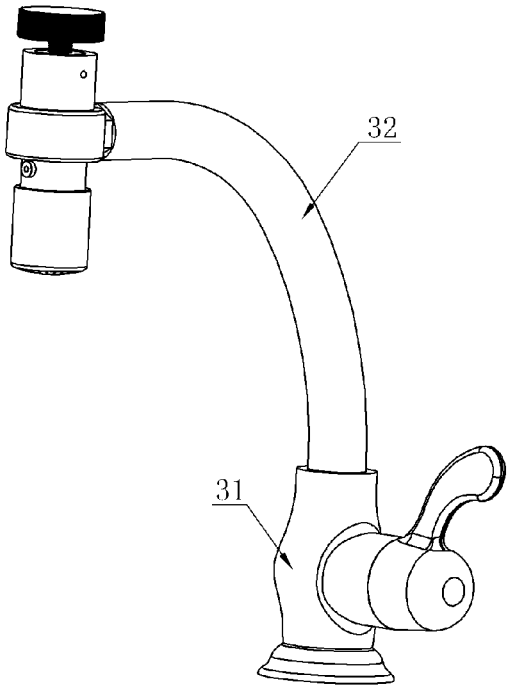
FIG. 4 illustrates a vertical installation of the main body of the water faucet directly through the external screwed joint 30, water pipe 32 and inflow switch tube socket 31, according to an embodiment of the present invention.

As it is shown in FIG. 4, the water faucet according to an embodiment of the invention, can realize a vertical connection of the inflow switch tube socket 31 and the water pipe 32.

Using the structure of the water faucet of the present invention obtains the following features:

1. This kind of water faucet is able to meet the high-quality integrated functional requirements of water appliances, and provides rational use of natural kinetic energy of tap water supply pressure which is of great practical value. Through the internal technical controlled jet aeration process, the tap water receives high efficiency with increased oxygen activation and the inherent technical functional effects increase water quality, and solves specific problems such as the water hypoxia, water quality aging and water quality degradation. This faucet structure is helpful in restoring the natural properties of water and realizes the functional improvement of the water faucet.
2. Users can easily and sensitively manipulate the stepless adjustment of water flow arbitrarily. The faucet can meet different people's water-using habits. For different water-using purposes, based on the interests of users or from their sensory perception, users can see clearly the changes in the water shape. It improves the efficiency of water-using.

Dynamic control will prevent water wasting to a reasonable minimum from the beginning of imperceptible water use in order to reduce the excessive use of water and achieve an objective of effective decontamination washing purposes. With more economical and practical interests, users can naturally select the most appropriate water flow, velocity, and water shape.

3. Within the water supply pressure range of 0.1 to 0.35 MPa, users can freely adjust and compensate for changes in water pressure, with a water consumption between 1.5 to 9 liters per minute. Moreover, the water faucet provides for implanting an external water source switch (auto-sensing switch) to lock the tap into the best water-saving form, reduce regulation time, and realize the switch re-opening without any further adjustment.

What is claimed is:

1. A water faucet having a main body comprising:

a water outlet channel (2);

a water inlet channel (3);

a flow ejector (5) with a vent hole (4) positioned between the water outlet channel (2) and the water inlet channel (3), the flow ejector having a back end with an inflow end formed as a flaring part;

in the back end of the flow ejector (5), a hollow inner circular tube wall (14) is equipped with a flow-adjusting positioning screw (6);

an adjustable shroud (7) equipped in a front end of the flow ejector (5) and at an exit end of an external tube wall of the water outlet channel (2);

a hollow flow regulating valve (8) positioned between the flow ejector (5) and the flow-adjusting positioning screw (6), the hollow flow regulating valve (8) having a T-shaped rear part and a conical head part, wherein an angle of a front of the conical head part is identical to an angle of the flaring part of the flow ejector;

a spray orifice (9) positioned in the cone-shaped head part of the hollow flow regulating valve;

a plurality of water inlet/outlet holes (10) located in a cylindrical wall of the hollow flow regulating valve (8);

a plurality of seal grooves (11) each arranged with a seal ring (12) positioned in a back-end tube wall of the hollow flow regulating valve (8);

a seal fixed block (16) equipped at a back-end of the hollow flow regulating valve (8), the seal fixed block having a centered opening at a rear-end with a process control screw hole (17); and an air inlet check valve (13) installed in the vent hole (4) of the flow ejector (5).

2. The water faucet according to claim 1 further comprising an internal screw nut (15) firmly implanted in a back-end of the main body in the hollow inner circular tube wall (14), wherein a bore diameter of the screw nut (15) is smaller than a bore diameter of the hollow inner circular tube wall (14), and through which the flow-adjusting positioning screw (6) is screwed into.

3. The water faucet according to claim 2, further comprising a jet hole (29) in the flow ejector (5), wherein a bore diameter of the spray orifice (9) in the hollow flow regulating valve (8) is smaller than a bore diameter of the jet hole (29).

4. The water faucet according to claim 3, wherein the bore diameter of the spray orifice (9) is within 0.8 to 1.8 mm, and the bore diameter of the jet hole (29) in the flow ejector (5) is within 2.5 to 4.5 mm.

5. The water faucet according to claim 1, further comprising a jet hole (29) in the flow ejector (5), wherein a bore diameter of the spray orifice (9) in the hollow flow regulating valve (8) is smaller than a bore diameter of the jet hole (29).

6. The water faucet according to claim 5, wherein the bore diameter of the spray orifice (9) is within 0.8 to 1.8 mm, and the bore diameter of the jet hole (29) in the flow ejector (5) is within 2.5 to 4.5 mm.

* * * * *